US006991516B1

(12) United States Patent
David et al.

(10) Patent No.: US 6,991,516 B1
(45) Date of Patent: Jan. 31, 2006

(54) CHEMICAL MECHANICAL POLISHING WITH MULTI-STAGE MONITORING OF METAL CLEARING

(75) Inventors: Jeffrey Drue David, San Jose, CA (US); Dirk De Roover, San Jose, CA (US); Jimin Zhang, San Jose, CA (US); Boguslaw A. Swedek, Cupertino, CA (US); Doyle E. Bennett, Santa Clara, CA (US); Manoocher Birang, Los Gatos, CA (US)

(73) Assignee: Applied Materials Inc., Santa Clara, CA (US)

( * ) Notice: Subject to any disclaimer, the term of this patent is extended or adjusted under 35 U.S.C. 154(b) by 0 days.

(21) Appl. No.: 10/920,726

(22) Filed: Aug. 17, 2004

Related U.S. Application Data

(60) Provisional application No. 60/496,182, filed on Aug. 18, 2003.

(51) Int. Cl.
*B24B 49/00* (2006.01)
*B24B 51/00* (2006.01)

(52) U.S. Cl. ..... 451/5; 451/6; 451/41

(58) Field of Classification Search ..... 451/5, 451/6, 8, 10, 11, 41, 286, 287; 438/692
See application file for complete search history.

(56) References Cited

U.S. PATENT DOCUMENTS

| | | | | |
|---|---|---|---|---|
| 5,081,796 | A | 1/1992 | Schultz | |
| 5,486,129 | A | 1/1996 | Sandhu et al. | |
| 5,658,183 | A | 8/1997 | Sandhu et al. | |
| 5,730,642 | A | 3/1998 | Sandhu et al. | |
| 5,964,653 | A | 10/1999 | Perlov et al. | |
| 5,985,094 | A | 11/1999 | Mosca | |
| 6,159,073 | A | 12/2000 | Wiswesser et al. | |
| 6,280,289 | B1 | 8/2001 | Wiswesser et al. | |
| 6,399,501 | B2 | 6/2002 | Birang et al. | |
| 6,422,927 | B1 | 7/2002 | Zuniga | |
| 6,450,868 | B1 | 9/2002 | Zuniga et al. | |
| 6,494,765 | B2 | 12/2002 | Gitis et al. | |
| 6,602,724 | B2 | 8/2003 | Redeker et al. | |
| 6,609,946 | B1 * | 8/2003 | Tran | 451/5 |
| 6,609,947 | B1 | 8/2003 | Moore | |
| 6,669,539 | B1 | 12/2003 | Amartur | |

(Continued)

FOREIGN PATENT DOCUMENTS

| | | | |
|---|---|---|---|
| DE | 3801969 | A | 7/1989 |
| EP | 0904895 | A | 3/1999 |

OTHER PUBLICATIONS

U.S. Appl. No. 10/396,299, filed Mar. 24, 2003, Bennett et al., 30 pp.
U.S. Appl. No. 10/920,701, filed Aug. 17, 2004, Bennett et al., 29 pp.

*Primary Examiner*—Jacob K. Ackun, Jr.
(74) *Attorney, Agent, or Firm*—Fish & Richardson

(57) ABSTRACT

A plurality of portions of a substrate are monitored during polishing at a first polishing station with an in-situ monitoring system. A plurality of thicknesses are determined based on measurements by the in-situ monitoring system, and the plurality of pressures to apply to the plurality of regions of the substrate are calculated in a closed-loop control system. However, if a representative thickness of the layer is less than a threshold thickness, calculation of the plurality of pressures by the closed-loop control system is halted and a plurality of predetermined pressures are applied to the plurality of regions of the substrate.

49 Claims, 6 Drawing Sheets

U.S. PATENT DOCUMENTS 6,766,215 B1 7/2004 Lensing et al.
6,776,692 B1 8/2004 Zuniga et al.
6,806,098 B2 * 10/2004 Ohtake et al. ..... 438/5
6,857,945 B1 2/2005 Chen et al.
2001/0000773 A1 * 5/2001 Campbell et al. ..... 451/41
2002/0164925 A1 11/2002 Swedek et al.
2003/0199112 A1 10/2003 Shanmugasundram et al.
2005/0024047 A1 2/2005 Miller et al.

* cited by examiner

CHEMICAL MECHANICAL POLISHING WITH MULTI-STAGE MONITORING OF METAL CLEARING

This application claims priority to U.S. patent application Ser. No. 60/496,182, filed on Aug. 18, 2003.

BACKGROUND

The present invention relates generally to chemical mechanical polishing of substrates, and more particularly to methods and apparatus for monitoring a metal layer during chemical mechanical polishing.

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head. The exposed surface of the substrate is placed against a moving polishing surface, such as a rotating polishing pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing liquid, such as a slurry containing abrasive particles, is supplied to the surface of the polishing pad.

One problem in CMP is determining whether the polishing process is complete, i.e., whether a substrate layer has been planarized to a desired flatness or thickness, or when a desired amount of material has been removed. Overpolishing (removing too much) of a conductive layer or film leads to increased circuit resistance. On the other hand, underpolishing (removing too little) of a conductive layer leads to electrical shorting. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, the polishing endpoint cannot be determined merely as a function of polishing time.

One way to determine the polishing endpoint is to remove the substrate from the polishing surface and examine it. For example, the substrate can be transferred to a metrology station where the thickness of a substrate layer is measured, e.g., with a profilometer or a resistivity measurement. If the desired specifications are not met, the substrate is reloaded into the CMP apparatus for further processing. This is a time-consuming procedure that reduces the throughput of the CMP apparatus. Alternatively, the examination might reveal that an excessive amount of material has been removed, rendering the substrate unusable.

More recently, in-situ monitoring of the substrate has been performed, e.g., with optical or capacitance sensors, in order to detect the polishing endpoint. Other proposed endpoint detection techniques have involved measurements of friction, motor current, slurry chemistry, acoustics and conductivity. One detection technique that has been considered is to induce an eddy current in the metal layer and detect a change in the eddy current as the metal layer is removed.

Another reoccurring problem in CMP is dishing of the substrate surface when polishing a filler layer to expose an underlying layer. Specifically, once the underlying layer is exposed, the portion of the filler layer located between the raised areas of the patterned underlying layer can be overpolished, creating concave depressions in the substrate surface. Dishing can render the substrate unsuitable for integrated circuit fabrication, thereby lowering process yield.

SUMMARY

In one aspect, the invention is directed to a method of chemical mechanical polishing a layer that covers an underlying surface on a substrate. The method includes polishing the layer at a first polishing station and applying a plurality of pressures to the plurality of regions of the substrate, monitoring a plurality of portions of the substrate during polishing at the first polishing station with an in-situ monitoring system, determining a plurality of thicknesses based on measurements by the in-situ monitoring system, calculating in a closed-loop control system the plurality of pressures to apply to the plurality of regions of the substrate, determining whether a representative thickness of the layer is less than a threshold thickness, and if the representative thickness is less than the threshold thickness, halting calculation of the plurality of pressures by the closed-loop control system and applying a plurality of first predetermined pressures to the plurality of regions of the substrate.

Implementations of the invention may include one or more of the following features. The first plurality of pressures may be calculated in the closed-loop control system based at least in part on the plurality of thickness measurements. The substrate may be transferred to a second polishing station and the substrate may be polished at the second polishing station with a second plurality of pressures. The plurality of first predetermined pressures may be applied during polishing at the second polishing station. The substrate may be transferred to the second polishing station after determining that the representative thickness is less than the threshold thickness. The second plurality of pressures may be provided by the plurality of first predetermined pressures and not calculated by the closed-loop control system, so halting calculation of pressures may include halting calculation of the first plurality of pressures. The substrate may be transferred to the second polishing station once the representative thickness is determined to be less than the threshold thickness. A second representative thickness of the layer may be determined to be less than a second threshold thickness, and the substrate may be transferred to the second polishing station once the second representative thickness is determined to be less than the second threshold thickness. The first threshold thickness may be less than the second threshold thickness. The plurality of portions of the substrate may be monitored during polishing at the second polishing station with a second in-situ monitoring system. A plurality of thicknesses may be determined based on measurements by the second in-situ monitoring system, and the second plurality of pressures to apply to the plurality of regions of the substrate may be calculated in the closed-loop control system. Halting calculation of pressures may include halting calculation of the first plurality of pressures. The step of determining whether the representative thickness is less than the threshold thickness may be performed when the substrate is at the second polishing station. The representative thickness may be between 500 and 2000 Angstroms, e.g., about 1000 Angstroms, and the second representative thickness is may be between 1500 and 4000 Angstroms.

Determining whether the representative thickness is less than the threshold thickness may include determining the representative thickness at least one of plurality of thicknesses or detecting that the layer is clearing. The plurality of portions of the substrate may be monitored with a second in-situ monitoring system at least after determining that the representative thickness is less than the threshold thickness. The in-situ monitoring system may be an eddy current monitoring system, and the layer may be a metal, e.g., copper. Alternatively, the in-situ monitoring system may comprise an optical monitoring system, and the layer may be a dielectric. The second in-situ monitoring system may be an optical monitoring system. The plurality of portions of the substrate may be continued to monitored with the optical monitoring system while applying the plurality of first predetermined pressures. If the optical monitoring system indicates that the metal layer is cleared from a particular portion of the substrate, a second predetermined pressure may be applied to the portion region. The second predetermined pressure may be lower than the first predetermined pressure. Applying the second predetermined pressure to the particular region may include decreasing the pressure monotonically from the first predetermined pressure to the second predetermined pressure. The second predetermined pressure may be about 30% to 70% of the first pressure. The substrate may be monitored for residual metal with the optical monitoring system while the second predetermined pressure is applied to at least one of the plurality of regions. If the optical monitoring system does not detect residual metal in the particular region of the substrate within a predetermined time, a third predetermined pressure may be applied to the particular region. The third predetermined pressure may be lower than the second predetermined pressure. The third predetermined pressure may be near zero, e.g., equal to or less than about 0.5 psi. If the optical monitoring system does not detect residual metal for any of the plurality of regions of the substrate for the predetermined time, polishing at the first polishing station may be halted. The underlying surface may be a barrier layer, which may cover a patterned dielectric layer. The substrate may be transferred to a second polishing station to polish the barrier layer. The plurality of regions may correspond to the plurality of portions.

In another aspect, the invention is directed to a method of chemical mechanical polishing a metal layer that covers an underlying surface on a substrate. The method includes polishing the metal layer at a first polishing station and applying a first predetermined pressure to each of a plurality of regions of the substrate as the metal layer is being cleared, monitoring the plurality of regions of the substrate during polishing with an optical monitoring system and, if the optical monitoring system indicates that the metal layer is cleared from a particular region of the substrate, applying a second predetermined pressure to the particular region, the second predetermined pressure being lower than the first predetermined pressure.

Implementations of the invention may include one or more of the following features. The substrate may be monitored for residual copper with the optical monitoring system while applying the second predetermined pressure to at least one of the plurality of regions. If the optical monitoring system does not detect residual copper in the particular region of the substrate within a predetermined time, a third predetermined pressure may be applied to the particular region. The third predetermined pressure may be lower than the second predetermined pressure.

In another aspect, the invention is directed to a method of chemical mechanical polishing a metal layer that covers an underlying surface on a substrate. The method includes polishing the substrate at a first polishing station and applying a first pressure to at least some of a plurality of regions of the substrate, monitoring the plurality of regions of the substrate during polishing with an optical monitoring system, determining whether the optical monitoring system does not detect residual metal for a predetermined time for at least some of the plurality of regions and, if the optical monitoring system does not detect residual metal for the predetermined time for a particular region, applying a second pressure to the particular region, the second predetermined pressure being lower than the first predetermined pressure.

In another aspect, the invention is directed to a polishing system that has a polishing pad support, a carrier head to hold a substrate and configured to apply a plurality of independently controllable pressures to a plurality of regions of the substrate, an in-situ monitoring system to monitor a plurality of regions of the substrate during polishing, and a controller configured to determining a plurality of thicknesses based on measurements by the in-situ monitoring system, calculate in a closed-loop control system the plurality of pressures to apply to the plurality of regions of the substrate, determine whether a representative thickness of the layer is less than a threshold thickness and if the representative thickness is less than the threshold thickness, halt calculation of the plurality of pressures by the closed-loop control system and apply a plurality of first predetermined pressures to the plurality of regions of the substrate.

In another aspect, the invention is directed to a polishing system that has a polishing pad support, a carrier head to hold a substrate and configured to apply a plurality of independently controllable pressures to a plurality of regions of the substrate, an optical monitoring system to monitor a plurality of regions of the substrate during polishing, and a controller configured to cause a plurality of predetermined pressures to be applied to a plurality of regions of the substrate as a metal layer is being cleared, determine whether the metal layer is cleared in a plurality of portions of the substrate, and if the metal layer is cleared in a particular portion of the substrate, apply a second predetermined pressure to the particular portion, the second predetermined pressure being lower than the first predetermined pressure.

In another aspect, the invention is directed to a polishing system that has a polishing pad support, a carrier head to hold a substrate and configured to apply a plurality of independently controllable pressures to a plurality of regions of the substrate, an optical monitoring system to monitor a plurality of regions of the substrate during polishing, and a controller configured to determine whether the optical monitoring system does not detect residual metal for a predetermined time and, if the optical monitoring system does not detect residual metal for the predetermined time for a particular region, apply a second pressure to the particular region, the second predetermined pressure being lower than the first predetermined pressure.

Possible advantages of implementations of the invention can include one or more of the following. During bulk polishing of the metal layer, the pressure profile applied by the carrier head can be adjusted to compensate for non-uniform polishing rates and non-uniform thickness of the incoming substrate. In addition, by using zone-based control of the carrier head during clearing to barrier, polishing uniformity can be further improved. Polishing can be stopped with high accuracy. Overpolishing and underpolishing can be reduced, as can dishing and erosion, thereby improving yield and throughput.

Other features and advantages of the invention will become apparent from the following description, including the drawings and claims.

DETAILED DESCRIPTION

Figure 1:
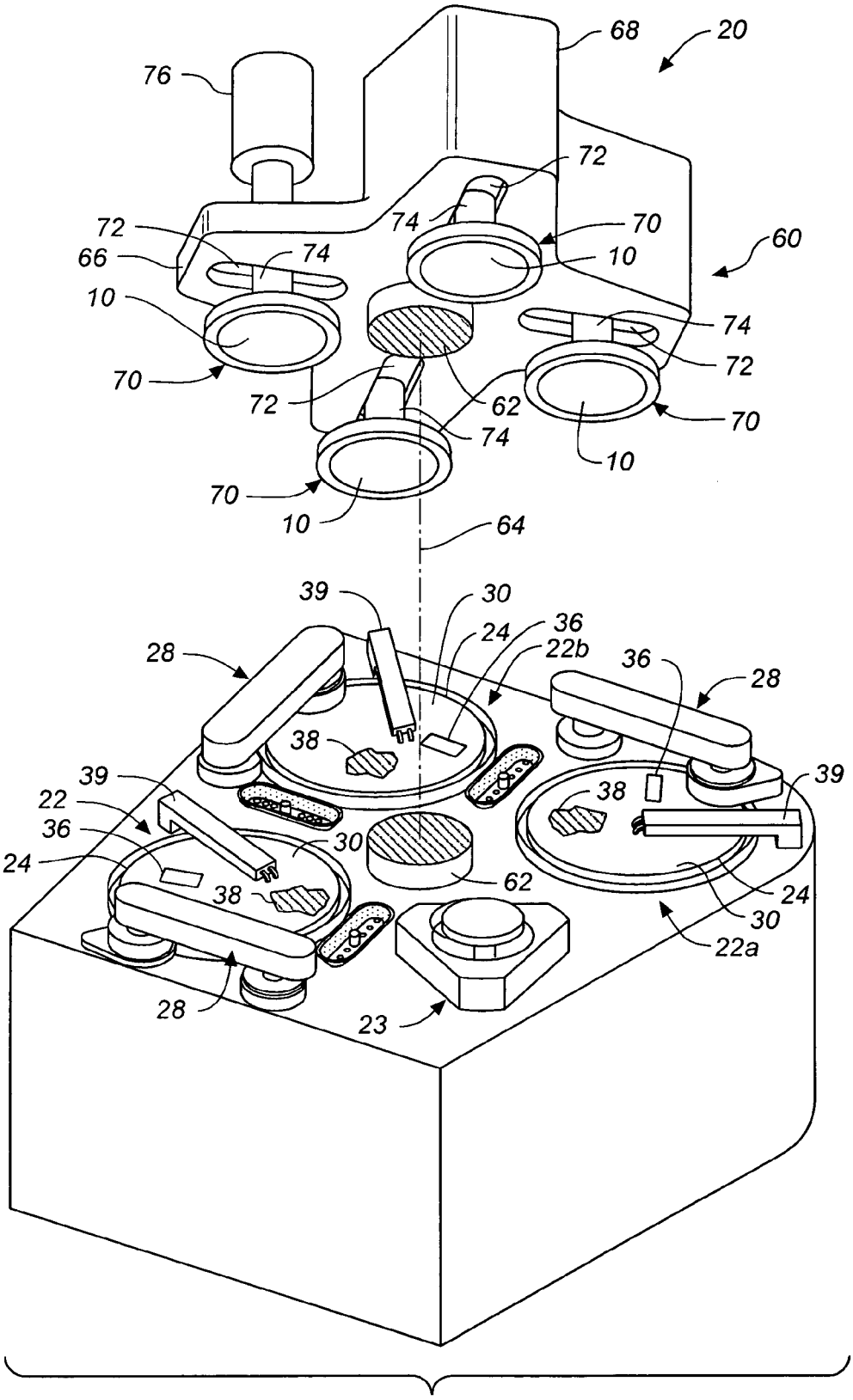
FIG. 1 is a schematic exploded perspective view of a chemical mechanical polishing apparatus.

Referring to FIG. 1, one or more substrates 10 can be polished by a CMP apparatus 20. A description of a similar polishing apparatus 20 can be found in U.S. Pat. No. 5,738,574, the entire disclosure of which is incorporated herein by reference. Polishing apparatus 20 includes a series of polishing stations 22*a*, 22*b* and 22*c*, and a transfer station 23. The transfer station 23 transfers the substrates between the carrier heads and a loading apparatus.

Each polishing station includes a rotatable platen 24 on which is placed a polishing pad 30. The first and second stations 22*a* and 22*b* can include a two-layer polishing pad with a hard durable outer surface or a fixed-abrasive pad with embedded abrasive particles. The final polishing station 22*c* can include a relatively soft pad or a two-layer pad. Each polishing station can also include a pad conditioner apparatus 28 to maintain the condition of the polishing pad so that it will effectively polish substrates.

Figure 2:
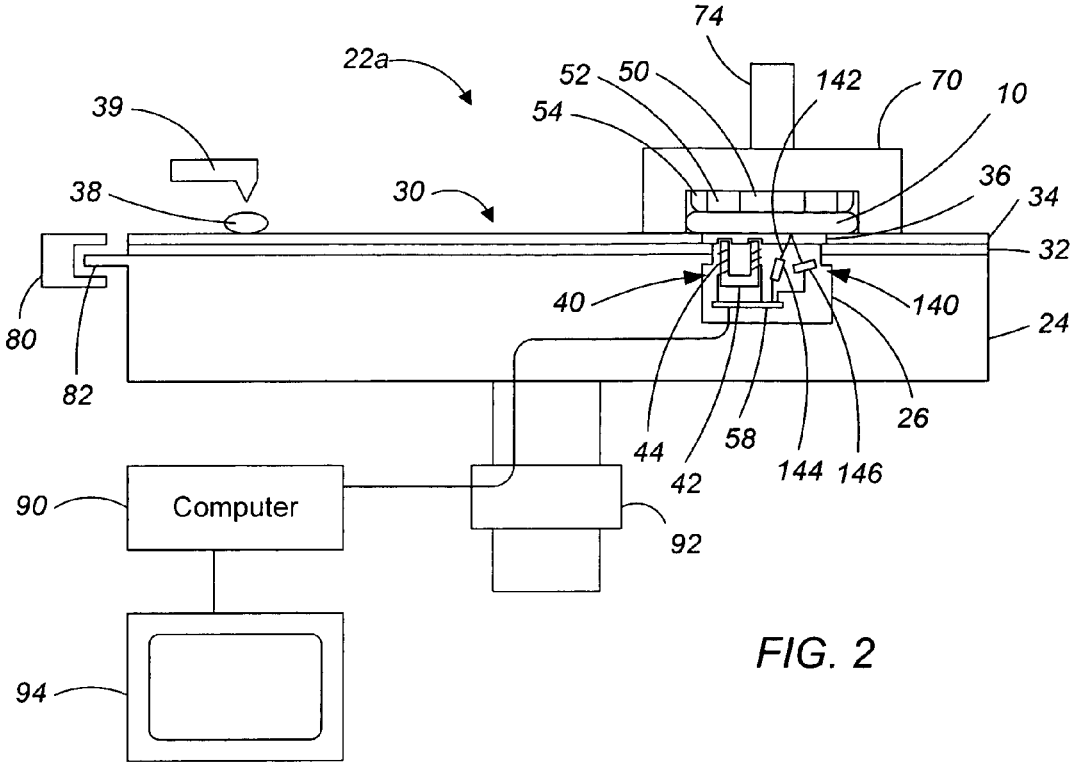
FIG. 2 is a schematic side view, partially cross-sectional, of a chemical mechanical polishing station that includes an eddy current monitoring system and an optical monitoring system.

Referring to FIG. 2, a two-layer polishing pad 30 typically has a backing layer 32 which abuts the surface of the platen 24 and a covering layer 34 which is used to polish the substrate 10. The covering layer 34 is typically harder than the backing layer 32. However, some pads have only a covering layer and no backing layer. The covering layer 34 can be composed of foamed or cast polyurethane, possibly with fillers, e.g., hollow microspheres, and/or a grooved surface. The backing layer 32 can be composed of compressed felt fibers leached with urethane. A two-layer polishing pad, with the covering layer composed of IC-1000 and the backing layer composed of SUBA-4, is available from Rodel, Inc., of Newark, Del. (IC-1000 and SUBA-4 are product names of Rodel, Inc.).

During a polishing step, a polishing liquid 38, such as an abrasive slurry or abrasive-free solution can be supplied to the surface of the polishing pad 30 by a slurry supply port or combined slurry/rinse arm 39. The same slurry solution may be used at the first and second polishing stations, whereas another slurry solution may be used at the third polishing station.

Returning to FIG. 1, a rotatable multi-head carousel 60 supports four carrier heads 70. The carousel is rotated by a central post 62 about a carousel axis 64 by a carousel motor assembly (not shown) to orbit the carrier head systems and the substrates attached thereto between the polishing stations 22*a*–22*c* and the transfer station 23. Three of the carrier head systems receive and hold substrates, and polish them by pressing them against the polishing pads. Meanwhile, one of the carrier head systems delivers a polished substrate to the transfer station 23 and receives an unpolished substrate from the transfer station 23.

Each carrier head 70 is connected by a carrier drive shaft 74 to a carrier head rotation motor 76 (shown by the removal of one quarter of cover 68) so that each carrier head can independently rotate about it own axis. In addition, each carrier head 70 independently laterally oscillates in a radial slot 72 formed in carousel support plate 66. In operation, the platen is rotated about its central axis, and the carrier head is rotated about its central axis and translated laterally across the surface of the polishing pad.

Figure 3:
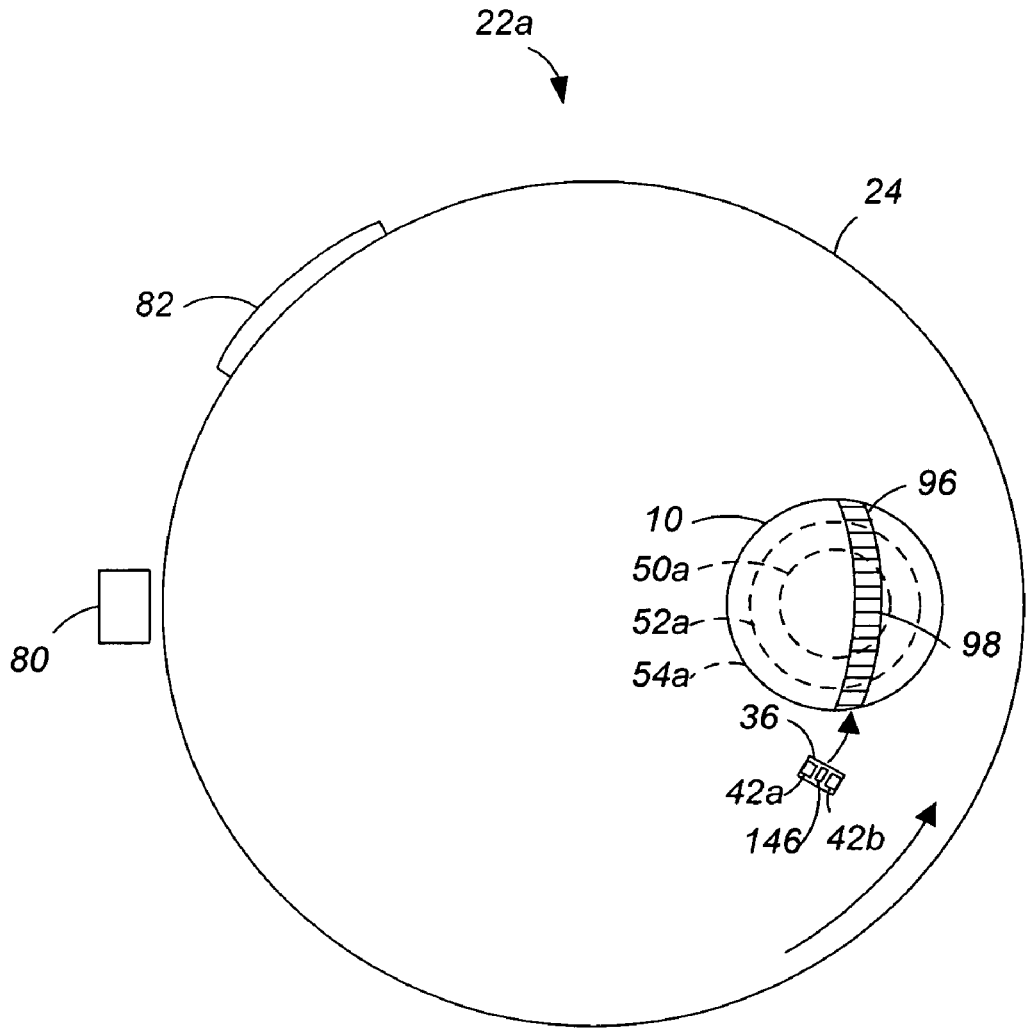
FIG. 3 is a schematic top view of a platen from the polishing station of FIG. 2.

Descriptions of a suitable carrier head 70 can be found in U.S. Pat. No. 6,422,927, and in U.S. patent application Ser. No. 09/712,389, filed Nov. 13, 2000, the entire disclosures of which are incorporated by reference. Referring to FIGS. 2 and 3, the carrier head 70 can independently apply different pressures to different radial zones of the substrate. For example, the carrier head may include a flexible membrane with a substrate receiving surface, and three independently pressurizable concentric chambers 50, 52 and 54 behind the membrane. Thus, the inner circular chamber 50 will apply a pressure to an inner circular region 50*a* of the substrate, the middle annular chamber 52 will apply a pressure to a middle annular region 52*a* of the substrate, and the outer annular chamber 54 will apply a pressure to an outer annular region 54*a* of the substrate (see FIG. 3).

Referring again to FIG. 2, a recess 26 is formed in the platen 24, and a transparent section 36 is formed in the polishing pad 30 overlying the recess 26. The transparent section 36 is positioned such that it passes beneath the substrate 10 during a portion of the platen's rotation, regardless of the translational position of the carrier head. Assuming that the polishing pad 32 is a two-layer pad, the transparent section 36 can be constructed by cutting an aperture in the backing layer 32, and by replacing a section of the cover layer 34 with a transparent plug. The plug can be a relatively pure polymer or polyurethane, e.g., formed without fillers. In general, the material of the transparent section 36 should be non-magnetic and non-conductive. In addition, the system can include a transparent cover, e.g., of glass or a hard plastic, that is placed over the recess 26 but is located below the polishing pad (the top surface of the cover can be coplanar with the top of the platen 24). In this case, the core of the eddy current sensor can extend through the cover and project partially into the polishing pad, or be located entirely below the cover (see FIG. 4).

At least one of the polishing stations, e.g., the first polishing station 22*a* or the second polishing station 22*b*, includes an in-situ eddy current monitoring system 40 and an optical monitoring system 140. The eddy current monitoring system 40 and optical monitoring system 140 can function as a polishing process control and endpoint detection system. The first polishing station 22*a* can include just an eddy current monitoring system, and the final polishing station 22*c* can include just an optical monitoring system, although either may additionally include an eddy current monitoring system or only an eddy current monitoring system or only an optical monitoring system.

As shown by FIG. 3, the sensor assembly of the monitoring system is embedded in the platen and sweeps beneath the substrate 10 with each rotation of the platen. Each time the sensor assembly sweeps beneath the substrate, data can be collected from the eddy current monitoring system 40 and optical monitoring system 140. Specifically, as the sensor assemblies sweep in a path 96 across the substrate, the monitoring systems will make a series of measurements 98. Each measurement 98 can be associated with a radial position on the substrate, as described in U.S. Pat. Nos. 6,159,073 and 6,280,289, the entire disclosures of which are incorporated herein by reference, for endpoint or process control.

Returning to FIG. 2, the eddy current monitoring system 40 induces and senses eddy currents in a metal layer on the substrate. The sensor assembly for the eddy current monitoring system 40 includes a core 42 positioned in the recess 26 to rotate with the platen, and a coil 44 wound around the core 42. The coil 44 is connected to a control system, some components of which can be located on a printed circuit board 58 inside the recess 26. A suitable control system is described in U.S. patent application Ser. No. 10/633,276, filed Jul. 31, 2003, the entire disclosure of which is incorporated by reference. A computer 90 can be coupled to the components in the platen, including the printed circuit board 58, through a rotary electrical union 92.

Figure 4:
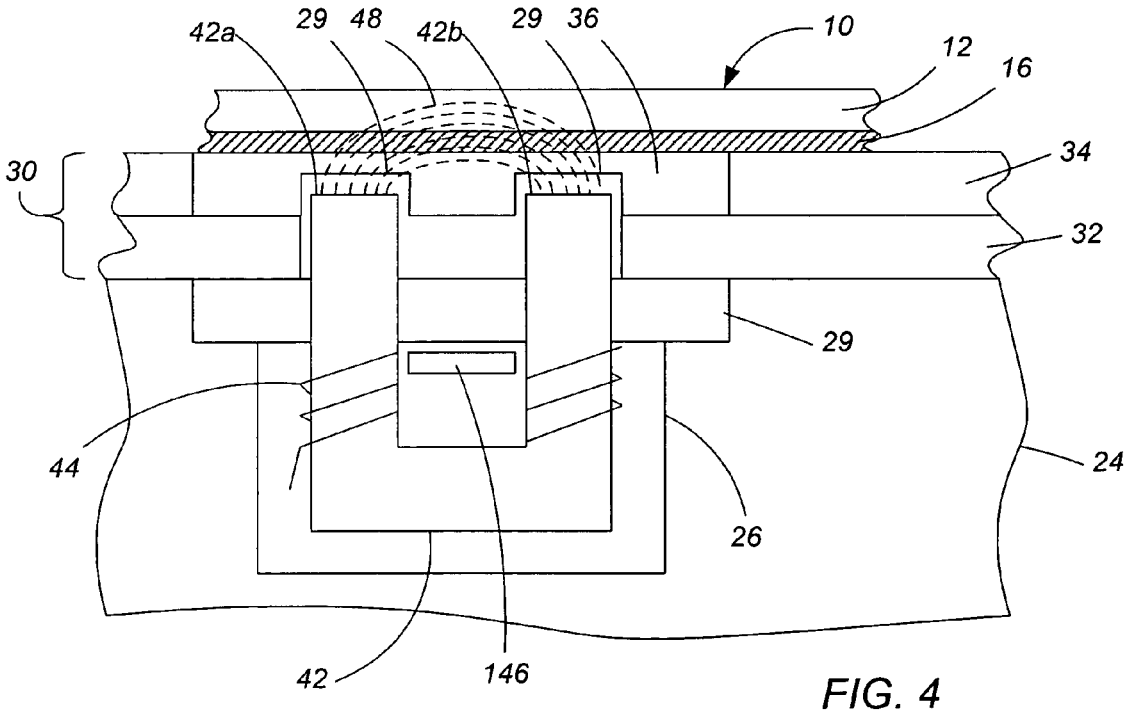
FIG. 4 is a schematic cross-sectional view illustrating a magnetic field generated by the eddy current monitoring system.

Referring to FIG. 4, the core 42 can be a U-shaped or E-shaped body formed of a non-conductive material with a relatively high magnetic permeability. The exact winding configuration, core composition and shape, and capacitor size can be determined experimentally. As shown, the lower surface of the transparent portion 36 may include two rectangular indentations 29, and the two prongs 42*a* and 42*b* of the core 42 may extend into the indentations so as to be positioned closer to the substrate. In addition, the light source and detector 146 can be positioned so that they monitor substantially the same portion of the substrate as the eddy current monitoring system, as described in U.S. patent application Ser. No. 09/847,867, filed May 2, 2001, the entire disclosure of which is incorporated by reference.

In operation, an oscillator in the controller drives the coil 44 to generate an oscillating magnetic field 48 that extends through the body of the core 42 and into the gap 46 between the two poles 42*a* and 42*b* of the core. At least a portion of the magnetic field 48 extends through the polishing pad 30 and into the substrate 10. If a metal layer 16 is present on the substrate 10, the oscillating magnetic field 48 generates eddy currents in the metal layer 16. The eddy currents cause the metal layer 16 to act as an impedance source that is coupled to the sense circuitry in the controller. As the thickness of the metal layer changes, the impedance changes. By detecting this change, the eddy current sensor can sense the change in the strength of the eddy currents, and thus the change in thickness of the metal layer 12.

Figure 5A:
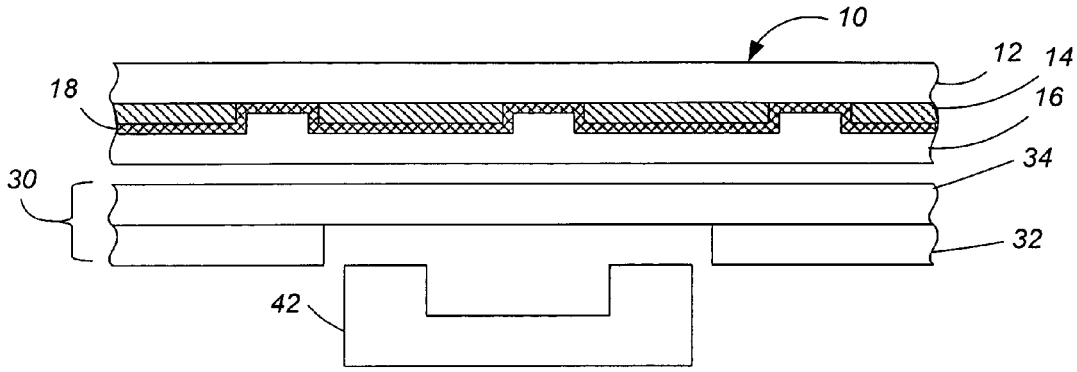
FIGS. 5A–5D schematically illustrate a method of detecting a polishing endpoint using an eddy current sensor.
Figure 5B:
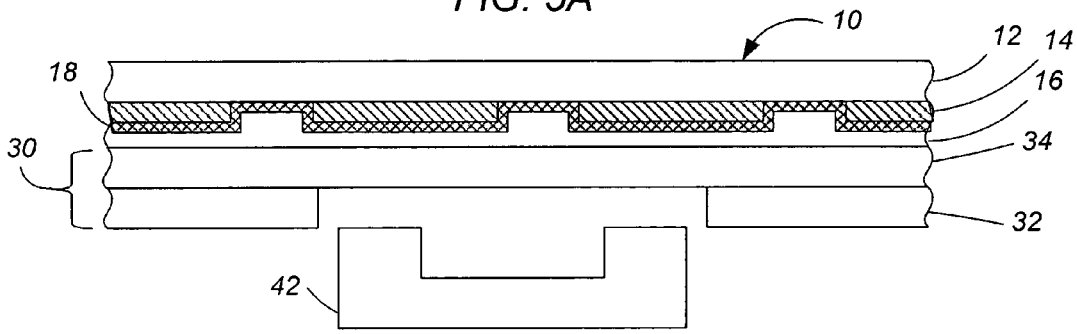

As shown in FIGS. 5A and 5B, for a polishing operation, the substrate 10 is placed in contact with the polishing pad 30. The substrate 10 can include a silicon wafer 12 and a conductive layer 16, e.g., a metal such as copper, disposed over one or more patterned underlying layers 14, which can be semiconductor, conductor or insulator layers. A barrier layer 18, such as tantalum or tantalum nitride, may separate the metal layer from the underlying patterned layers.

After polishing, the portion of the metal layer remaining between the pattern of the underlying layer will provide metal features, e.g., vias, pads and interconnects. However, prior to polishing the bulk of conductive layer 16 is initially relatively thick and continuous and has a low resistivity, and relatively strong eddy currents can be generated in the conductive layer 16. As previously mentioned, the eddy currents cause the metal layer to function as an impedance source in parallel with the coil 44.

Referring to FIG. 5B, as the substrate 10 is polished, the bulk portion of the conductive layer 16 is thinned. As the conductive layer 16 thins, its sheet resistivity increases, and the eddy currents in the metal layer become dampened. Consequently, the coupling between metal layer 16 and the sensor is reduced (i.e., increasing the resistivity of the virtual impedance source).

Figure 5C:
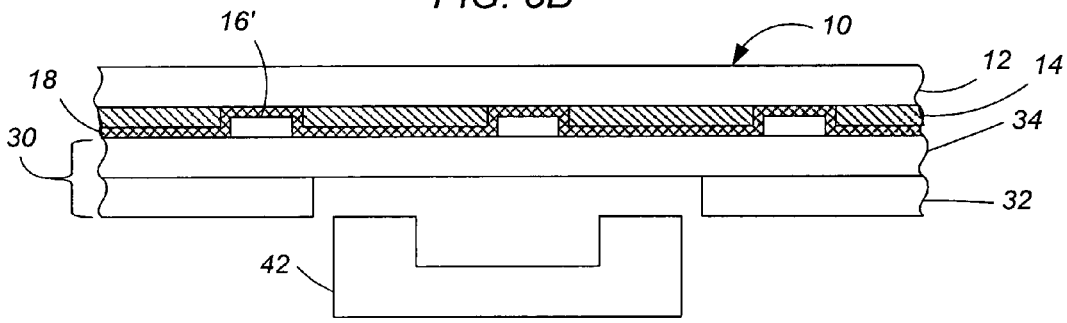

Referring to FIG. 5C, eventually the bulk portion of the conductive layer 16 is removed, exposing the barrier layer 18 and leaving conductive interconnects 16' in the trenches between the patterned insulative layer 14. At this point, the coupling between the conductive portions in the substrate, which are generally small and generally non-continuous, and the sensor reaches a minimum.

Figure 5D:
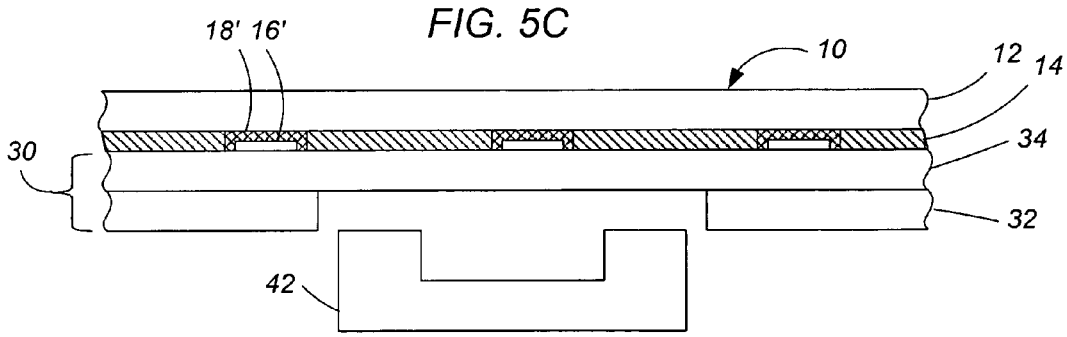

Referring to FIG. 5D, continued polishing removes the barrier layer 18 and exposes the underlying insulative layer 14, leaving conductive interconnects 16' and buried barrier layer films 18' in the trenches between the patterned insulative layer 14.

Returning to FIG. 2, the optical monitoring system 140, which can function as a reflectometer or interferometer, can be secured to the platen 24 in the recess 26 adjacent the eddy current monitoring system 40. Thus, the optical monitoring system 140 can measure the reflectivity of substantially the same location on the substrate as is being monitored by the eddy current monitoring system 40. Specifically, the optical monitoring system 140 can be positioned to measure a portion of the substrate at the same radial distance from the axis of rotation of the platen 24 as the eddy current monitoring system 40. Thus, the optical monitoring system 140 can sweep across the substrate in the same path as the eddy current monitoring system 40.

The optical monitoring system 140 includes a light source 144 and a detector 146. The light source generates a light beam 142 which propagates through the transparent window section 36 and the slurry to impinge upon the exposed surface of the substrate 10. For example, the light source 144 may be a laser and the light beam 142 may be a collimated laser beam. The light laser beam 142 can be projected from the laser 144 at an angle $\alpha$ from an axis normal to the surface of the substrate 10. The light source can be configured so that the light beam impinges a point at the center of the region on the substrate monitored by the eddy current monitoring system. In addition, if the hole 26 and the window 36 are elongated, a beam expander (not illustrated) may be positioned in the path of the light beam to expand the light beam along the elongated axis of the window.

Referring to FIGS. 2 and 3, the CMP apparatus 20 can also include a position sensor 80, such as an optical interrupter, to sense when the core 42 and the light source 44 are beneath the substrate 10. For example, the optical interrupter could be mounted at a fixed point opposite carrier head 70. A flag 82 is attached to the periphery of the platen. The point of attachment and length of the flag 82 is selected so that it interrupts the optical signal of the sensor 80 while the transparent section 36 sweeps beneath the substrate 10.

Alternately, the CMP apparatus can include an encoder to determine the angular position of platen.

A general purpose programmable digital computer 90 receives signals from the eddy current sensing system and the optical monitoring system. Since the sensor assembly sweep beneath the substrate with each rotation of the platen, information on the metal layer thickness and exposure of the underlying layer is accumulated in-situ and on a continuous real-time basis (once per platen rotation). The computer 90 can be programmed to sample measurements from the monitoring system when the substrate generally overlies the transparent section 36 (e.g., as determined by the position sensor). As polishing progresses, the reflectivity or thickness of the metal layer changes, and the sampled signals vary with time. The time varying sampled signals may be referred to as traces. The measurements from the monitoring systems can be displayed on an output device 94 during polishing to permit the operator of the device to visually monitor the progress of the polishing operation. In addition, as discussed below, the traces may be used to control the polishing process and determine the end-point of the metal layer polishing operation.

In operation, the CMP apparatus 20 uses the eddy current monitoring system 40 and optical monitoring system 140 to determine when the bulk of the filler layer has been removed and to determine when the underlying stop layer has been substantially exposed. The computer 90 applies process control and endpoint detection logic to the sampled signals to determine when to change process parameter and to detect the polishing endpoint. Possible process control and endpoint criteria for the detector logic include local minima or maxima, changes in slope, threshold values in amplitude or slope, or combinations thereof.

In addition, the computer 90 can be programmed to divide the measurements from both the eddy current monitoring system 40 and the optical monitoring system 140 from each sweep beneath the substrate into a plurality of sampling zones 98, to calculate the radial position on the substrate for each sampling zone, to sort the measurements into radial ranges, to determine minimum, maximum and average measurements for each sampling zone, and to use multiple radial ranges to determine the polishing endpoint, as discussed in U.S. Pat. No. 6,399,501, the entirety of which is incorporated herein by reference.

The computer 48 may also be connected to the pressure mechanisms that control the pressure applied by the carrier head 70, to the carrier head rotation motor 76 to control the carrier head rotation rate, to the platen rotation motor (not shown) to control the platen rotation rate, or to the slurry distribution system 39 to control the slurry composition supplied to the polishing pad. Specifically, after sorting the measurements into radial ranges, information on the metal film thickness can be fed in real-time into a closed-loop controller to periodically or continuously modify the polishing pressure profile applied by a carrier head, as discussed in U.S. patent application Ser. No. 09/609,426, filed Jul. 5, 2000, the entirety of which is incorporated herein by reference. For example, the computer could determine that the endpoint criteria have been satisfied for the outer radial ranges but not for the inner radial ranges. This would indicate that the underlying layer has been exposed in an annular outer area but not in an inner area of the substrate. In this case, the computer could reduce the pressure applied to an outer area of the substrate.

Figure 6:
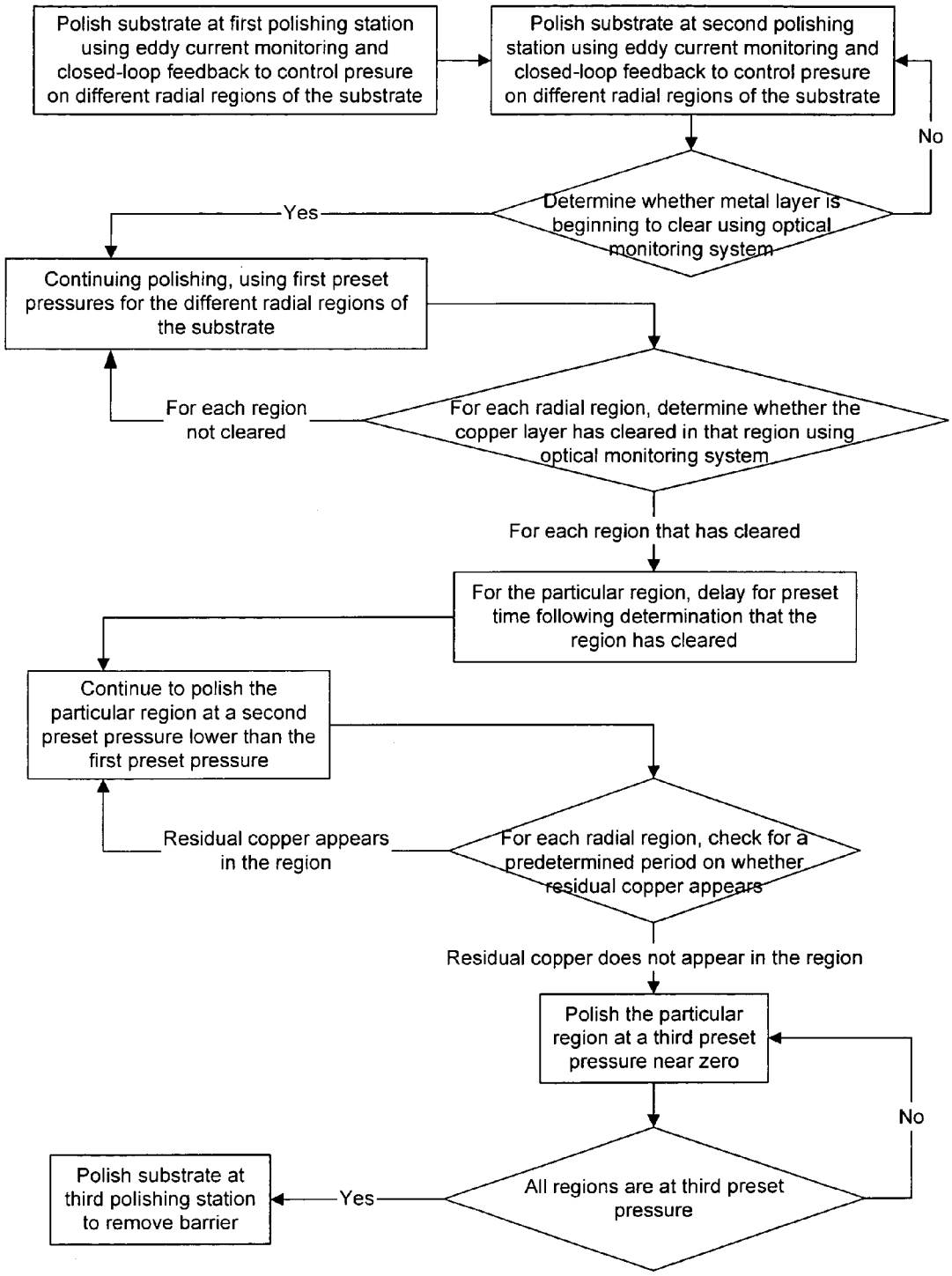
FIG. 6 is a flowchart illustrating a method of polishing a metal layer.

A method of polishing a metal layer, such as a copper layer, is shown in flowchart form in FIG. 6.

First, the substrate is polished at the first polishing station 22*a* to remove the bulk of the metal layer. The polishing process is monitored by the eddy current monitoring system 40. As polishing progresses at the first polishing station, the radial thickness information from the eddy current monitoring system 40 can be fed into a closed-loop feedback system to control the pressure on different regions of the substrate (or to control the size of the loading area). The closed-loop control system calculates pressures to apply to the different regions of the substrate. This permits the carrier head to compensate for the non-uniformity in the polishing rate or for non-uniformity in the thickness of the metal layer of the incoming substrate. The pressure of the retaining ring on the polishing pad may also be adjusted to adjust the polishing rate.

When a predetermined thickness, e.g., a thickness between 1500 and 4000 Angstroms, such as 2000 Angstroms, of the copper layer 14 remains over the underlying barrier layer 16 (see FIG. 5B), the polishing process is halted and the substrate is transferred to the second polishing station 22*b*. As a result, after polishing at the first polishing station, a significant portion of the metal layer has been removed and the surface of the metal layer remaining on the substrate is substantially planarized.

At the second polishing station 22*b*, the substrate is initially polished at a high polishing rate to complete remove the bulk of the metal layer. This first phase of the polishing process at the second polishing station is also monitored by the eddy current monitoring system 40, and again the radial thickness information from the eddy current monitoring system 40 can be fed into a closed-loop feedback system to control the pressure and/or the loading area of the carrier head 70 on the substrate to compensate for non-uniformities in the polishing rate or for non-uniformities in the thickness of the metal layer of the incoming substrate.

Exemplary polishing parameters in this first at the second polishing station include a platen rotation rate of 60 rpm, and a carrier head pressure of between 1.5 and 6.0 psi. The exact pressures will depend on the polishing process being performed (including the type of device being polished) and the feedback from the closed-loop control process. However, the operating pressures on the substrate at the second polishing station should be lower than those at the first polishing station.

When the eddy current monitoring system detects that a predetermined thickness of the copper layer 14 remains over the barrier layer, the polishing system stops using the closed-loop feedback system, and switches to using a first set of preset pressures for the regions on the substrate (each region may have a different preset pressure). These preset pressures are not subject to adjustment by the closed-loop control. The preset pressures can be higher or lower than the pressures used in the first phase of polishing, depending on whether the closed-loop control process is compensating for underpolishing or overpolishing. The predetermined thickness can be between 500 Å and 2000 Å, e.g., 1000 Å.

Alternatively, the second phase of polishing using the preset pressures could be initiated when the optical monitoring system first indicates that any of the regions of the substrate are being cleared, e.g., when the reflectivity trace for any of the regions begins to drop. Thus, in this implementation, the closed-loop control of the carrier head pressures continues until the optical monitoring system indicates that the substrate is beginning to be cleared (rather than stopping when the predetermined thickness of the metal layer remains).

In this second phase of polishing at the second platen, the optical monitoring system continues to monitor the polishing process at the second polishing station 22*b*. Specifically, each radial region on the substrate is individually monitored. If the optical monitoring system indicates that an individual zone has cleared (e.g., by the reflected light intensity or slope of the optical monitoring signal for that region dropping below a predetermined threshold), the computer 90 commences a third phase of polishing for that particular zone.

In the third phase of polishing, which each chamber of the carrier can commence independently based on whether the associated region on the substrate has cleared, the computer causes the pressure applied for that region to drop to a second preset pressure. This second preset pressure is lower than the first preset pressure. For example, for each region, the second preset pressures can be up to 70% lower, e.g., about 30% to 70% lower, than the first preset pressures for the same zone. For example, the second preset pressures may be in the range of 1 to 2 psi.

Optionally, the computer 90 can cause the pressure applied to a chamber to decrease monotonically so that the chamber reaches the second preset pressure after a predetermined period after the optical monitoring system indicates that the associated zone has cleared. An exemplary delay is about 2 to 8 seconds. The chamber pressure can decrease along a linear ramp or it may "decay", e.g., exponentially.

Since the polishing rate may vary across the substrate, individually controlling the zones during the clearing process ensures that the pressure is reduced for a particular zone when the metal layer has been removed in that zone. Consequently, overpolishing and dishing can be reduced or eliminated, and a high polishing uniformity can be achieved.

The optical monitoring system continues to monitor the substrate during this third phase at the second polishing station. Specifically, once the optical monitoring system indicates that a particular zone has cleared, the system continues to monitor that zone for residual copper (e.g., as indicated by spikes in the reflectivity measurements).

Assuming that no residual copper is detected in a predetermined period of time, for a particular zone, the system progresses to fourth phase in which the pressure for that zone is reduced even further, e.g., to near zero, such as 0.5 psi. The predetermined period of time, e.g., ten scans of the optical monitoring system, or about 10 seconds. On the other hand, if residual copper is detected during this period, then the timer or counter is reset, and the optical monitoring system must continue to monitor for residual copper.

Once all zones have entered the fourth phase (i.e., all of the zones have been reduced to the lowest pressure), the system can indicate that polishing is complete at the second polishing station 22*b*.

Thus, polishing proceeds at the second polishing station 22*b* until the metal layer is removed and the underlying barrier layer is exposed. Since the reflectivity information from the optical monitoring system 40 was fed back into the control system so as to reduce the pressure when the metal layer in a particular region clears, this method prevents the regions of the barrier layer that are exposed earliest from becoming overpolished and subject to dishing.

By reducing the polishing rate as the barrier layer is exposed, dishing and erosion effects can be reduced. Furthermore, the relative reaction time of the polishing machine is improved, enabling the polishing machine to halt polishing and transfer to the third polishing station with less material removed after the final endpoint criterion is detected. Moreover, more intensity measurements can be collected near the expected polishing end time, thereby potentially improving the accuracy of the polishing endpoint calculation. However, by maintaining a high polishing rate throughout most of the polishing operation at the first polishing station, high throughput is achieved. On the other hand, by switching from eddy current monitoring to optical monitoring before the metal layer has cleared, the likelihood of using erroneous thickness measurements by the closed-loop control system is reduced, and thus the chance of unexpected or chaotic polishing behavior is also diminished. Furthermore, by using zone-based control of the carrier head and determining which zones to bring to near zero pressure with the optical monitoring system during clearing to barrier, polishing uniformity can be further improved.

Once the metal layer has been removed at the second polishing station 22*b*, the substrate is transferred to the third polishing station 22*c* for removal of the barrier layer. The polishing process is monitored at the third polishing station 22*c* by an optical monitoring system, and proceeds until the barrier layer is substantially removed and the underlying dielectric layer is substantially exposed.

Figure 7:
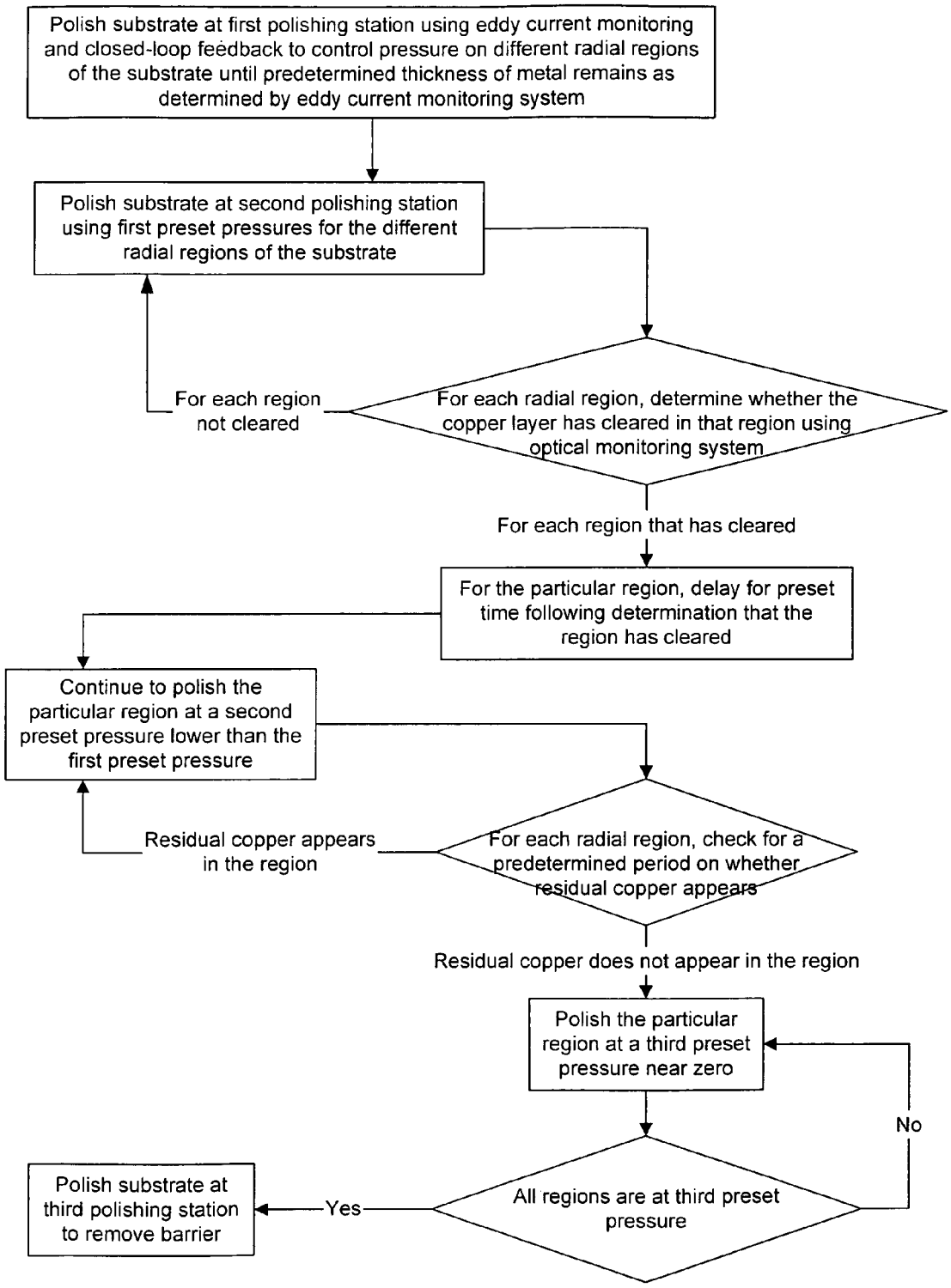
FIG. 7 is a flowchart illustrating an alternative method of polishing a metal layer.

In an alternative method, illustrated in FIG. 7, the substrate is polished at the first polishing station 22*a* to remove the bulk of the metal layer using the closed-loop control system. When a predetermined thickness, e.g., a thickness between 500 and 2000 Angstroms, for example, between 800 and 1500 Angstroms, such as 1000 Angstroms, of the copper layer 14 remains over the underlying barrier layer 16, the polishing process is halted and the substrate is transferred to the second polishing station 22*b*. In general, as compared to the method described above, in this implementation less of the copper layer can remain on the substrate when it is transferred to the second polishing station. At the second polishing station, the polishing system does not use closed-loop feedback system, but switches to using the second phase of polishing using the first set of preset pressures for the regions on the substrate. At the second polishing station, each radial region on the substrate is individually monitored, and if the optical monitoring system indicates that an individual zone has cleared (e.g., by the reflected light intensity or slope of the optical monitoring signal for that region dropping below a predetermined threshold), the computer 90 commences a third phase of polishing for that particular zone. The method described in reference to FIG. 7 can otherwise be similar to the method described in reference to FIG. 6.

In yet another alternative method, all of the polishing of the metal layer is performed at the first polishing station 22*a*. Removal of the barrier layer is performed at the second polishing station 22*b*, and a buffing step is performed at the final polishing station 22*c*. In this implementation, the first, second and third phases all occur at the first polishing station.

Optionally, when the polishing begins at any of the polishing stations, the substrate may be briefly polished, e.g., for about 10 seconds, at a somewhat higher pressure than the default or average pressure for the remainder of the polishing step at that station. This initial polishing, which can be termed an "initiation" step, may be needed to remove native oxides formed on the metal layer or to compensate for ramp-up of the platen rotation rate and carrier head pressure so as to maintain the expected throughput.

The eddy current and optical monitoring systems can be used in a variety of polishing systems. Either the polishing pad, or the carrier head, or both can move to provide relative motion between the polishing surface and the substrate. The polishing pad can be a circular (or some other shape) pad secured to the platen, a tape extending between supply and take-up rollers, or a continuous belt. The polishing pad can be affixed on a platen, incrementally advanced over a platen between polishing operations, or driven continuously over the platen during polishing. The pad can be secured to the platen during polishing, or there could be a fluid bearing between the platen and polishing pad during polishing. The polishing pad can be a standard (e.g., polyurethane with or without fillers) rough pad, a soft pad, or a fixed-abrasive pad.

Although illustrated as positioned in the same hole, the optical monitoring system 140 could be positioned at a different location on the platen than the eddy current monitoring system 40. For example, the optical monitoring system 140 and eddy current monitoring system 40 could be positioned on opposite sides of the platen, so that they alternately scan the substrate surface. Various aspects of the invention still apply if the eddy current sensor uses separate drive and sense coils instead of a single coil.

Although described in the context of polishing of a metal layer, some aspects of the invention would be applicable to polishing of a dielectric layer, e.g., an oxide layer. For example, if the optical monitoring system includes an interferometer or spectrometer that can generate thickness measurements of a dielectric layer, then these thickness measurements could be fed into a closed-loop feedback system to control the applied pressures during bulk polishing. Then, once the thickness of the dielectric layer falls below a predetermined threshold, the system could switch to using preset pressures.

Computer programs to carry out the invention may be tangibly embodied in computer-readable medium, such as disks or memory of the computer 90.

The present invention has been described in terms of a preferred embodiment. The invention, however, is not limited to the embodiment depicted and described. Rather, the scope of the invention is defined by the appended claims.

What is claimed is:

1. A method of chemical mechanical polishing a layer that covers an underlying surface on a substrate, comprising:

polishing the layer at a first polishing station and applying a first plurality of pressures to a plurality of regions of the substrate;

monitoring a plurality of portions of the substrate during polishing at the first polishing station with a first in-situ monitoring system;

determining a plurality of thicknesses based on measurements by the first in-situ monitoring system;

calculating in a closed-loop control system the first plurality of pressures to apply to the plurality of regions of the substrate;

determining whether a representative thickness of the layer is less than a threshold thickness; and if the representative thickness is less than the threshold thickness, halting calculation of pressures by the closed-loop control system and applying a plurality of first predetermined pressures to the plurality of regions of the substrate.

2. The method of claim 1, wherein the first plurality of pressures are calculated in the closed-loop control system based at least in part on the plurality of thickness measurements.

3. The method of claim 1, further comprising transferring the substrate to a second polishing station and polishing the substrate at the second polishing station with a second plurality of pressures, and wherein the plurality of first predetermined pressures are applied during polishing at the second polishing station.

4. The method of claim 3, wherein the substrate is transferred to the second polishing station after the representative thickness is determined to be less than the threshold thickness, wherein the second plurality of pressures are provided by the plurality of first predetermined pressures, and wherein the second plurality of pressures are not calculated by the closed-loop control system.

5. The method of claim 4, wherein the substrate is transferred to the second polishing station once the representative thickness is determined to be less than the threshold thickness.

6. The method of claim 4, wherein determining whether the representative thickness is less than the threshold thickness includes comparing at least one of the plurality of thicknesses to the threshold thickness.

7. The method of claim 4, wherein determining whether the representative thickness is less than the threshold thickness includes detecting that the layer is clearing.

8. The method of claim 4, wherein halting calculation of pressures includes halting calculation of the first plurality of pressures.

9. The method of claim 3, further comprising determining whether a second representative thickness of the layer is less than a second threshold thickness, and transferring the substrate to the second polishing station once the second representative thickness is determined to be less than the second threshold thickness, wherein the first threshold thickness is less than the second threshold thickness.

10. The method of claim 9, further monitoring the plurality of portions of the substrate during polishing at the second polishing station with a second in-situ monitoring system.

11. The method of claim 10, further comprising determining a plurality of thicknesses based on measurements by the second in-situ monitoring system, and calculating in the closed-loop control system the second plurality of pressures to apply to the plurality of regions of the substrate.

12. The method of claim 11, wherein halting calculation of pressures includes halting calculation of the second plurality of pressures.

13. The method of claim 12, wherein the step of determining whether the representative thickness is less than the threshold thickness is performed when the substrate is at the second polishing station.

14. The method of claim 13, wherein determining whether the representative thickness is less than the threshold thickness includes comparing at least one of the plurality of thicknesses to the threshold thickness.

15. The method of claim 13, wherein determining whether the representative thickness is less than the threshold thickness includes detecting that the layer is clearing.

16. The method of claim 10, wherein the second representative thickness is between 1500 and 4000 Angstroms.

17. The method of claim 1, wherein determining whether the representative thickness is less than the threshold thickness includes comparing at least one of the plurality of thicknesses to the threshold thickness.

18. The method of claim 17, wherein the representative thickness is between 500 and 2000 Angstroms.

19. The method of claim 18, wherein the representative thickness is about 1000 Angstroms.

20. The method of claim 17, wherein the in-situ monitoring system comprises an eddy current monitoring system.

21. The method of claim 1, wherein determining whether the representative thickness is less than the threshold thickness includes detecting that the layer is clearing.

22. The method of claim 21, wherein detecting that the layer is clearing includes detecting with an optical monitoring system.

23. The method of claim 22, wherein the in-situ monitoring system comprises an eddy current monitoring system.

24. The method of claim 1, further comprising monitoring the plurality of portions of the substrate with a second in-situ monitoring system at least after determining that the representative thickness is less than the threshold thickness.

25. The method of claim 24, wherein the in-situ monitoring system comprises an eddy current monitoring system, the second in-situ monitoring system comprises an optical monitoring system, and the layer is a metal.

26. The method of claim 1, wherein the in-situ monitoring system comprises an optical monitoring system, and the layer is a dielectric.

27. The method of claim 1, wherein the in-situ monitoring system comprises an eddy current monitoring system and the layer is a metal layer.

28. The method of claim 1, further comprising monitoring the plurality of portions of the substrate with an optical monitoring system at least after determining that the representative thickness is less than the threshold thickness.

29. The method of claim 28, further comprising continuing to monitor the plurality of portions of the substrate with the optical monitoring system while applying the plurality of first predetermined pressures.

30. The method of claim 29, wherein if the optical monitoring system indicates that the metal layer is cleared from a particular portion of the substrate, applying a second predetermined pressure to the portion region, the second predetermined pressure being lower than the first predetermined pressure.

31. The method of claim 30, wherein applying the second predetermined pressure to the particular region includes decreasing the pressure monotonically from the first predetermined pressure to the second predetermined pressure.

32. The method of claim 30, wherein the second predetermined pressure is up to about 70% lower than the first pressure.

33. The method of claim 30, further comprising monitoring the substrate for residual metal with the optical monitoring system while applying the second predetermined pressure to at least one of the plurality of regions.

34. The method of claim 33, wherein if the optical monitoring system does not detect residual metal in the particular region of the substrate within a predetermined time, a third predetermined pressure is applied to the particular region, the third predetermined pressure being lower than the second predetermined pressure.

35. The method of claim 34, wherein the third predetermined pressure is near zero.

36. The method of claim 35, wherein the third predetermined pressure is equal to or less than about 0.5 psi.

37. The method of claim 35, wherein if the optical monitoring system does not detect residual metal for any of the plurality of regions of the substrate for the predetermined time, polishing at the first polishing station is halted.

38. The method of claim 1, wherein the layer is a metal lying and the underlying surface is a barrier layer.

39. The method of claim 38, wherein metal is copper.

40. The method of claim 38, wherein the barrier layer covers a patterned dielectric layer.

41. The method of claim 40, further comprising transferring the substrate to a second polishing station to polish the barrier layer.

42. The method of claim 1, wherein the plurality of regions correspond to the plurality of portions.

43. A method of chemical mechanical polishing a metal layer that covers an underlying surface on a substrate, comprising:

polishing the metal layer at a first polishing station and applying a first predetermined pressure to each of a plurality of regions of the substrate as the metal layer is being cleared;

monitoring the plurality of regions of the substrate during polishing with an optical monitoring system; and if the optical monitoring system indicates that the metal layer is cleared from a particular region of the substrate, applying a second predetermined pressure to the particular region, the second predetermined pressure being lower than the first predetermined pressure.

44. The method of claim 43, further comprising monitoring the substrate for residual copper with the optical monitoring system while applying the second predetermined pressure to at least one of the plurality of regions.

45. The method of claim 44, wherein if the optical monitoring system does not detect residual copper in the particular region of the substrate within a predetermined time, a third predetermined pressure is applied to the particular region, the third predetermined pressure being lower than the second predetermined pressure.

46. A method of chemical mechanical polishing a metal layer that covers an underlying surface on a substrate, comprising:

polishing the substrate at a first polishing station and applying a first pressure to at least some of a plurality of regions of the substrate;

monitoring the plurality of regions of the substrate during polishing with an optical monitoring system;

determining whether the optical monitoring system does not detect residual metal for a predetermined time for the at least some of the plurality of regions; and if the optical monitoring system does not detect residual metal for the predetermined time for a particular region, applying a second pressure to the particular region, the second predetermined pressure being lower than the first predetermined pressure.

47. A polishing system, comprising:

a polishing pad support;

a carrier head to hold a substrate and configured to apply a plurality of independently controllable pressures to a plurality of regions of the substrate;

an in-situ monitoring system to monitor a plurality of regions of the substrate during polishing; and a controller configured to determine a plurality of thicknesses based on measurements by the in-situ monitoring system, calculate in a closed-loop control system the plurality of pressures to apply to the plurality of regions of the substrate, determine whether a representative thickness of the layer is less than a threshold thickness, and if the representative thickness is less than the threshold thickness, halt calculation of the plurality of pressures by the closed-loop control system and apply a plurality of first predetermined pressures to the plurality of regions of the substrate.

48. A polishing system, comprising:

a polishing pad support;

a carrier head to hold a substrate and configured to apply a plurality of independently controllable pressures to a plurality of regions of the substrate;

an optical monitoring system to monitor a plurality of regions of the substrate during polishing; and a controller configured to cause a plurality of predetermined pressures to be applied to a plurality of regions of the substrate as a metal layer is being cleared, determine whether the metal layer is cleared in a plurality of portions of the substrate, and if the metal layer is cleared in a particular portion of the substrate, apply a second predetermined pressure to the particular portion, the second predetermined pressure being lower than the first predetermined pressure.

49. A polishing system, comprising:

a polishing pad support;

a carrier head to hold a substrate and configured to apply a plurality of independently controllable pressures to a plurality of regions of the substrate;

an optical monitoring system to monitor a plurality of regions of the substrate during polishing; and a controller configured determine whether the optical monitoring system does not detect residual metal for a predetermined time, and if the optical monitoring system does not detect residual metal for the predetermined time for a particular region, applying a second pressure to the particular region, the second predetermined pressure being lower than the first predetermined pressure.

* * * * *